US011457789B2

(12) United States Patent
Ortmann

(10) Patent No.: US 11,457,789 B2
(45) Date of Patent: Oct. 4, 2022

(54) AUTOMATICALLY MOVING ROBOTIC VACUUM CLEANER AS WELL AS SYSTEM COMPRISED OF AN AUTOMATICALLY MOVING ROBOTIC VACUUM CLEANER ROBOT AND AN EXTERNAL VACUUM CLEANING APPARATUS

(71) Applicant: Vorwerk & Co. Interholding GmbH, Wuppertal (DE)

(72) Inventor: Roman Ortmann, Duisburg (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 359 days.

(21) Appl. No.: 16/837,219

(22) Filed: Apr. 1, 2020

(65) Prior Publication Data

US 2020/0323410 A1 Oct. 15, 2020

(30) Foreign Application Priority Data

Apr. 11, 2019 (DE) ..... 10 2019 109 634.0

(51) Int. Cl.

| | |
|---|---|
| ***A47L 5/14*** | (2006.01) |
| ***A47L 9/08*** | (2006.01) |
| ***A47L 9/28*** | (2006.01) |
| ***A47L 9/32*** | (2006.01) |
| ***A47L 9/02*** | (2006.01) |
| ***A47L 9/10*** | (2006.01) |

(52) U.S. Cl.

CPC ..... *A47L 9/32* (2013.01); *A47L 9/02* (2013.01); *A47L 9/10* (2013.01); *A47L 9/2805* (2013.01); *A47L 9/2836* (2013.01); *A47L 2201/04* (2013.01)

(58) Field of Classification Search

CPC .... A47L 2201/00; A47L 2201/04; A47L 9/00; A47L 9/02; A47L 9/10; A47L 9/12; A47L 9/2805; A47L 9/2836; A47L 9/32

See application file for complete search history.

(56) References Cited

U.S. PATENT DOCUMENTS

2007/0226949 A1* 10/2007 Hahm ..... A47L 9/009 15/340.1
2017/0055796 A1* 3/2017 Won ..... A47L 11/4097
2021/0393093 A1* 12/2021 Alsweis ..... A47L 9/2878

FOREIGN PATENT DOCUMENTS

DE 102010000607 A1 * 9/2011 ..... A47L 5/225
WO WO-2007137234 A2 * 11/2007 ..... A47L 11/24

* cited by examiner

*Primary Examiner* — Marc Carlson
(74) *Attorney, Agent, or Firm* — Collard & Roe, P.C.

(57) ABSTRACT

An automatically moving robotic vacuum cleaner has a housing and a filter chamber for receiving suction material. The housing has a housing opening that is formed on the upper side of the housing and has a displaceable sealing element, which can be displaced from a closed position that closes the housing opening into a released position that releases the housing opening, so as to enable access to the filter chamber. The closure element can be mounted on the housing in a linearly movable manner. There is a detection device that is set up to detect the presence of an external vacuum cleaning apparatus to be connected with the housing opening in the area of the housing opening of the robotic vacuum cleaner. The robotic vacuum cleaner also has a control device that is set up to control an opening of the housing opening upon detection of the external vacuum cleaning apparatus.

10 Claims, 3 Drawing Sheets

AUTOMATICALLY MOVING ROBOTIC VACUUM CLEANER AS WELL AS SYSTEM COMPRISED OF AN AUTOMATICALLY MOVING ROBOTIC VACUUM CLEANER ROBOT AND AN EXTERNAL VACUUM CLEANING APPARATUS

CROSS REFERENCE TO RELATED APPLICATIONS

Applicant claims priority under 35 U.S.C. § 119 of German Application No. 10 2019 109 634.0 filed Apr. 11, 2019, the disclosure of which is incorporated by reference.

BACKGROUND OF THE INVENTION

1. Field of the Invention

The invention relates to an automatically moving robotic vacuum cleaner with a housing and a filter chamber for receiving suction material, wherein the housing has a housing opening that is formed on the upper side of the housing relative to a usual orientation of the robotic vacuum cleaner during an automatic movement and has a displaceable sealing element, which can be displaced from a closed position that closes the housing opening into a released position that releases the housing opening, so as to enable access to the filter chamber, specifically a vacuuming out of the interior of the filter chamber by means of an external vacuum cleaning apparatus manually guided by the user.

In addition, the invention relates to a system comprised of such a robotic vacuum cleaner and an external vacuum cleaning apparatus, in particular a vacuum cleaning apparatus manually guided by a user, wherein the housing opening of the robotic vacuum cleaner and a correspondingly shaped suction opening of the vacuum cleaning apparatus can be connected with each other in such a way that the filter chamber of the robotic vacuum cleaner can be vacuumed out by means of the vacuum cleaning apparatus.

2. Description of the Related Art

Robotic vacuum cleaners are sufficiently known in the art. These cleaners usually have a so-called permanent filter, which provides a filter chamber for receiving suction material. For emptying purposes, this permanent filter can be removed from the housing of the robotic vacuum cleaner, or regenerated by means of an external vacuum cleaning apparatus by vacuuming out the suction material present in the interior of the filter chamber by means of the fan of the external vacuum cleaning apparatus. For example, the external vacuum cleaning apparatus can be a different vacuum cleaner, in particular a vacuum cleaning apparatus manually guided by a user, but also a different robotic vacuum cleaner. In addition, the vacuum cleaning apparatus can be part of a base station to which the robotic vacuum cleaner docks, so as to receive services, here for example regenerating the filter chamber, but also other services, such as charging an accumulator, cleaning a cleaning brush or the like.

In order to vacuum out the filter chamber of the robotic vacuum cleaner by means of a vacuum cleaning apparatus manually guided by a user, it is further known for the user to open a closure element on the housing of a robotic vacuum cleaner and if necessary also an opening of the filter chamber, if the housing opening and filter chamber opening do not coincide to yield a single opening. The user can thereupon connect the housing opening or filter chamber opening with a suction opening of the vacuum cleaning apparatus.

SUMMARY OF THE INVENTION

Proceeding from the aforementioned prior art, the object of the invention is to further develop the robotic vacuum cleaner in such a way as to make its use even more comfortable for a user, wherein the filter chamber can be regenerated with only a little or preferably no assistance by the user.

In order to achieve this object, it is initially proposed that the closure element of the robotic vacuum cleaner be mounted on the housing in a linearly movable manner, wherein an engagement area of the closure element for shifting the closure element from outside of the housing is mechanically contactable, and wherein the robotic vacuum cleaner has a detection device that is set up to detect the presence of an external vacuum cleaning apparatus to be connected with the housing opening in the area of the housing opening of the robotic vacuum cleaner. The robotic vacuum cleaner has a control device that is set up to control an opening of the housing opening if the presence of an external vacuum cleaning apparatus is detected.

According to the invention, the mounting of the closure element is now suitable for fully automatic activation, since the closure element is not folded away from the housing of the robotic vacuum cleaner for releasing the housing opening, with the displacement motion of the closure element instead taking place linearly, in particular parallel to a housing surface of the robotic vacuum cleaner. For example, this prevents objects in the environment of the robotic vacuum cleaner from being able to get into a swivel radius of the closure element, thereby not allowing the housing opening to open. The closure is now arranged and formed on the robotic vacuum cleaner in such a way as to enable a fully automatic docking and regeneration of the filter chamber, for example on a base station, or an opening of the housing opening for vacuuming out the filter chamber with an external vacuum cleaning apparatus, without there being a danger that the vacuum cleaning apparatus will undesirably bump against the closure element. In particular, it is proposed that an engagement area of the movable closure element be designed to be mechanically contacted by an external vacuum cleaning apparatus, i.e., in particular be accessible from outside, so that the closure element can also be moved manually by a user or a vacuum cleaning apparatus manually guided by the latter. The engagement area is preferably formed on the closure element in such a way as to protrude from a surface of the closure element and/or be part of a lateral surface of the closure element, wherein an engagement plane of the engagement area and the direction of movement are not oriented parallel to each other, in particular are oriented orthogonally to each other. An engagement area designed in this way makes it easier to engage the closure element, so as to achieve a displacement of the closure element from the closed position into the released position through mechanical contact and the application of a sliding force.

The detection device is suitable for detecting when an external vacuum cleaning apparatus is approaching the robotic vacuum cleaner in order to regenerate the filter chamber of the robotic vacuum cleaner. To this end, the detection device has a detection area in which the presence of the external vacuum cleaning apparatus can be detected. Proceeding from the detection device, the detection area can span an area with a maximum distance of 20 cm or less to the detection device, for example. The smaller the detection area, the closer the vacuum cleaning apparatus must be brought to the robotic vacuum cleaner, but the less danger there also is that other objects in the detection area will trigger a signal. As soon as a partial area of the external vacuum cleaning apparatus enters into the detection area, the detection device can detect it and transmit a corresponding detection signal to a control device of the robotic vacuum cleaner, which provides information about the presence of the external vacuum cleaning apparatus. The detection area of the detection device preferably lies within the area of the housing opening, for example adjacent thereto, so that no object present in the environment of the robotic vacuum cleaner will be interpreted as a connection request. In this sense, it is advantageous for the housing opening to be arranged on an upper side of the robotic vacuum cleaner—relative to a conventional orientation of the robotic vacuum cleaner during an operation—and the detection area of the detection device to not face in a potential direction of movement by the robotic vacuum cleaner, but rather upwardly proceeding from the housing of the robotic vacuum cleaner, for example. As mentioned above, it can here also preferably be provided that the detection device have a limited detection range, so that an object located at a distance away from the detection device that exceeds a maximum distance is not classified as an external vacuum cleaning apparatus to be connected. It can alternatively or additionally be provided that the detection device transmit a detected distance from an obstacle to the control device of the robotic vacuum cleaner, which then compares the detected distance with a defined maximum distance, and if the distance is determined to be greater than the maximum distance, does not prompt the housing opening to open. As a consequence, it can be ensured that the housing opening is only opened and access is only permitted to the filter chamber of the robotic vacuum cleaner if it can be assumed with overwhelming probability that a an external vacuum cleaning apparatus is to be connected with the robotic vacuum cleaner. In addition, it is also possible that the detection device be set up to detect other parameters of an object in proximity to the housing opening, so that it can determine whether a present object is actually an external vacuum cleaning apparatus. For example, these parameters can include a direction of movement of the object, a size of the object, a shape of the object or the like. It is likewise possible that the detection device recognize the presence of an external vacuum cleaning apparatus by virtue of the latter mechanically contacting a partial area of the detection device.

It is proposed that the housing have a guiding device for guiding the sliding displacement of the closure element, wherein the guiding device is arranged on the robotic vacuum cleaner relative to the housing opening in such a way that the closure element can be shifted along the guiding device from the closed position into the released position and vice versa. In particular, the guiding device can have two guiding elements that run parallel to each other, along and between which the closure element is slidably mounted, wherein the guiding elements in particular can be part of a slotted guide and/or rail guide. The guiding device of the robotic vacuum cleaner is used for directedly guiding the linear shifting motion of the closure element. The guiding device is preferably designed as a three-dimensional slotted guide or as a rail guide in which the closure element can be shifted. According to one embodiment, the guiding device can have two guiding elements, within the guiding region of which the housing opening of the robotic vacuum cleaner is arranged, so that the closure element can get over the housing opening while performing the shifting motion and close it. Given two rail guides aligned parallel to each other, the housing opening preferably is located between the latter. In particular, the housing opening is located in the guiding area of the guiding device at an end-side partial area, for example so that a stop element of the guiding device and/or guiding elements defines the position of the closure element that lines up with the housing opening.

It is further proposed that the robotic vacuum cleaner have a displacement device that displaces the closure element. For example, the displacement device can be an electric motor controlled by the control device of the robotic vacuum cleaner. The displacement device can additionally—or also alternatively—have a spring element, whose restoring force is directed from the released position of the closure element into the closed position, so that the closure element is displaced back into the closed position once an opening force acting on the closure element has been eliminated. As a result, the housing opening is automatically closed upon the removal of an external vacuum cleaning apparatus from the housing opening. In an especially preferred embodiment, the housing opening is both opened and closed without the assistance of a user, and closure element displacement is initiated as soon as it has been determined that an external vacuum cleaning apparatus is located in front of the housing opening, and is to be connected with the latter in terms of flow or removed from the housing opening. As a consequence, it is no longer necessary that the user manually engage the closure element so as to displace it relative to the housing opening.

With respect to the detection device of the robotic vacuum cleaner, it is proposed that it have a contact sensor and/or a magnetic field sensor and/or an imaging device. The contact sensor is designed to recognize contact between an object and a corresponding detection area of the detection device, and transmit information about a detected contact to the control device of the robotic vacuum cleaner. The contact sensor reacts to the mechanical contact, wherein a minimum force must preferably be exerted on the detection area for it to recognize the contact as a valid request for the connection of an external vacuum cleaning apparatus. For example, the contact sensor can be configured for contact with a partial area of the external vacuum cleaning apparatus, wherein a user preferably places a handheld vacuum cleaning apparatus on the contact sensor, and just the weight force of the vacuum cleaning apparatus is enough to exceed the defined minimum force. If necessary, a pulse can be transmitted to the contact sensor as well, for example by virtue of the user of the vacuum cleaning apparatus additionally pressing against the contact sensor. The contact sensor can further also be set up to detect a direction of the mechanical force exerted on the contact sensor, so as to potentially be able to distinguish between external vacuum cleaning apparatuses and other objects in the environment. For example, the contact sensor can be integrated into a peripheral area of the housing opening, so that a signal for the control device of the robotic vacuum cleaner is generated when the vacuum cleaning apparatus comes into contact with the housing opening. In a special embodiment, for example, the signal can be generated by means of an electromechanical switch by closing a circuit through contact between the vacuum cleaning apparatus and contact sensor. The switch is here preferably located on a typical contact point between the robotic vacuum cleaner and vacuum cleaning apparatus, in particular directly on the housing opening. A magnetic field sensor can alternatively also be used in making the detection device. For example, the magnetic field sensor can be a Hall sensor, which supplies an output voltage dependent on a magnetic field. In this embodiment, a partial area of an external vacuum cleaning apparatus to be connected with the housing opening can have a permanent magnet, for example, the magnetic field of which can be detected by the Hall sensor of the robotic vacuum cleaner. The Hall sensor then supplies an output voltage proportional to the magnetic flux density of the permanent magnet. The detection device can further alternatively or additionally have an imaging device as well. The imaging device is preferably a camera arranged on the robotic vacuum cleaner or a chip set up to capture images, for example a CCD chip. The imaging device has a detection area that preferably covers a coupling area in front of the housing opening, so that an external vacuum cleaning apparatus approaching the housing opening can be detected. The signals recorded by the imaging device, in particular images, are preferably processed by an image processing program, so that the presence of an external vacuum cleaning apparatus in the area of the housing opening can be detected. To this end, the image processing program can compare the recorded images with reference images of vacuum cleaning apparatuses that can suitably be connected with the housing opening of the robotic vacuum cleaner. This makes it possible to prevent other objects or even unsuitable vacuum cleaning apparatuses in the environment of the robotic vacuum cleaner from being able to initiate an opening of the housing opening.

In particular, it is proposed that the detection device be set up to recognize a position and/or orientation of the external vacuum cleaning apparatus relative to the housing opening of the robotic vacuum cleaner. This embodiment is suitable in particular when the detection device has an imaging device. How and where the external vacuum cleaning apparatus is positioned relative to the housing opening can be recognized by comparing the images recorded by the detection device with reference images that show various positions and/or orientations of external vacuum cleaning apparatuses. For example, however, a valid position and/or orientation of the external vacuum cleaning apparatus on the robotic vacuum cleaner could also be recognized by a contact sensor or an array of contact sensors, which are contacted given a proper abutment of the vacuum cleaning apparatus against the robotic vacuum cleaner.

A preferred embodiment proposes that the control device of the robotic vacuum cleaner be set up to control a movement of the robotic vacuum cleaner relative to the external vacuum cleaning apparatus as a function of the detection signal of the detection device in such a way that the housing opening comes into contact with the external vacuum cleaning apparatus, so as to establish a flow connection between the filter chamber of the robotic vacuum cleaner and a suction opening of the external vacuum cleaning apparatus. In this embodiment, the detection device initially detects the position and/or orientation of the external vacuum cleaning apparatus relative to the housing opening of the robotic vacuum cleaner, and transmits the result to the control device, which thereupon determines which positional and/or orientational deviation the detected position and/or orientation of the vacuum cleaning apparatus has relative to a position and/or orientation necessary for properly coupling the vacuum cleaning apparatus to the housing opening of the robotic vacuum cleaner. The control device thereupon controls the robotic vacuum cleaner in such a way that it automatically moves and aligns itself relative to the detected external vacuum cleaning apparatus, for example travels and/or rotates toward it, until the housing opening has reached a position relative to the external vacuum cleaning apparatus in which a partial area of the external vacuum cleaning apparatus having a suction opening is connected with the housing opening of the robotic vacuum cleaner in terms of flow. The design of the housing opening of the robotic vacuum cleaner is especially preferably rotationally symmetrical, in particular round, so that not just a single position exists in which the partial area of the external vacuum cleaning apparatus having the suction opening can be connected with the housing opening of the robotic vacuum cleaner. During the movement of the robotic vacuum cleaner, the partial area of the vacuum cleaning apparatus preferably glides along the guiding device described above, which is formed on the housing of the robotic vacuum cleaner, thus resulting in a directed movement of the vacuum cleaning apparatus in the housing opening.

Apart from the control signals that set the robotic vacuum cleaner in motion for alignment with the external vacuum cleaning apparatus, it can also be provided that, while connecting the housing opening of the robotic vacuum cleaner with an external vacuum cleaning apparatus, a corresponding suction power level of the vacuum cleaning apparatus be set to enable an optimal cleaning result. In addition, the signal could also make a fan of the robotic vacuum cleaner operational to support regeneration of the filter chamber, for example by having the fan built into the robotic vacuum cleaner blow suction material that accumulated in the filter chamber out of the housing opening. The operation of the robotic vacuum cleaner fan is here preferably initiated if and only if the detection device recognizes that an external vacuum cleaning apparatus is actually connected with the housing opening of the robotic vacuum cleaner in a proper and dustproof manner.

It is further proposed that the control device be set up to initiate the displacement of the closure element into the released position via a movement of the robotic vacuum cleaner against the external vacuum cleaning apparatus, so that the closure element is displaced into an open position through exposure to the mechanical force of the external vacuum cleaning apparatus. According to this embodiment, in the event the detection device recognizes contact between an external vacuum cleaning apparatus and the robotic vacuum cleaner, a signal is generated for the robot to move in such a way that the movable closure element releases the housing opening for vacuuming out the filter chamber. The robotic vacuum cleaner travels against the partial area of the vacuum cleaning apparatus having the suction opening in such a way that the vacuum cleaning apparatus comes into contact with the closure element, and the closure element is displaced into the released position as the robotic vacuum cleaner continues to move. The external vacuum cleaning apparatus must here merely be kept in one place by the user. However, it is not necessary for the user to move the external vacuum cleaning apparatus toward the robotic vacuum cleaner. Instead, the robotic vacuum cleaner itself handles the alignment relative to the suction opening of the vacuum cleaning apparatus.

As a whole, the process of regenerating the filter chamber can thus be automated, wherein the closure element of the robotic vacuum cleaner is placed on the housing of the robotic vacuum cleaner and configured in such a way that the connection can be established between the robotic vacuum cleaner and external vacuum cleaning apparatus, without requiring any supplementary or preparatory manual intervention by a user. The connection can instead be established fully automatically by the robotic vacuum cleaner. To this end, the closure element, in particular its position, shape and/or size, is especially advantageously adjusted to the partial area of the external vacuum cleaning apparatus having the suction opening. Support in establishing the flow connection is provided by a directed movement of the autonomous robotic vacuum cleaner once a coupling request of an external vacuum cleaning apparatus has been recognized.

Apart from the robotic vacuum cleaner described above, the invention further also proposes a system comprised of such an automatically moving robotic vacuum cleaner and an external vacuum cleaning apparatus, wherein the housing opening of the robotic vacuum cleaner and a correspondingly shaped suction opening of the vacuum cleaning apparatus can be connected with each other in such a way that the filter chamber of the robotic vacuum cleaner can be vacuumed out by means of the vacuum cleaning apparatus. In particular, the external vacuum cleaning apparatus can be a vacuum cleaning apparatus manually guided by a user. Alternatively, however, the vacuum cleaning apparatus can also be part of an essentially immobile base station for the robotic vacuum cleaner, or alternatively likewise be an automatically moving robotic vacuum cleaner. In the system according to the invention, the housing opening of the robotic vacuum cleaner is designed in such a way that it can be opened by a corresponding partial area of the external vacuum cleaning apparatus, which especially preferably has a suction opening. Otherwise, the features and advantages described above in relation to the automatically moving robotic vacuum cleaner also apply correspondingly to the system with such a robotic vacuum cleaner and an external vacuum cleaning apparatus.

In particular, it is proposed that the closure element of the robotic vacuum cleaner can be moved from the closed position into the released position by means of a partial area of the vacuum cleaning apparatus having the suction opening, wherein the robotic vacuum cleaner further especially preferably has a guiding device that is designed both for guiding the closure element and for guiding the partial area of the vacuum cleaning apparatus having the suction opening.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
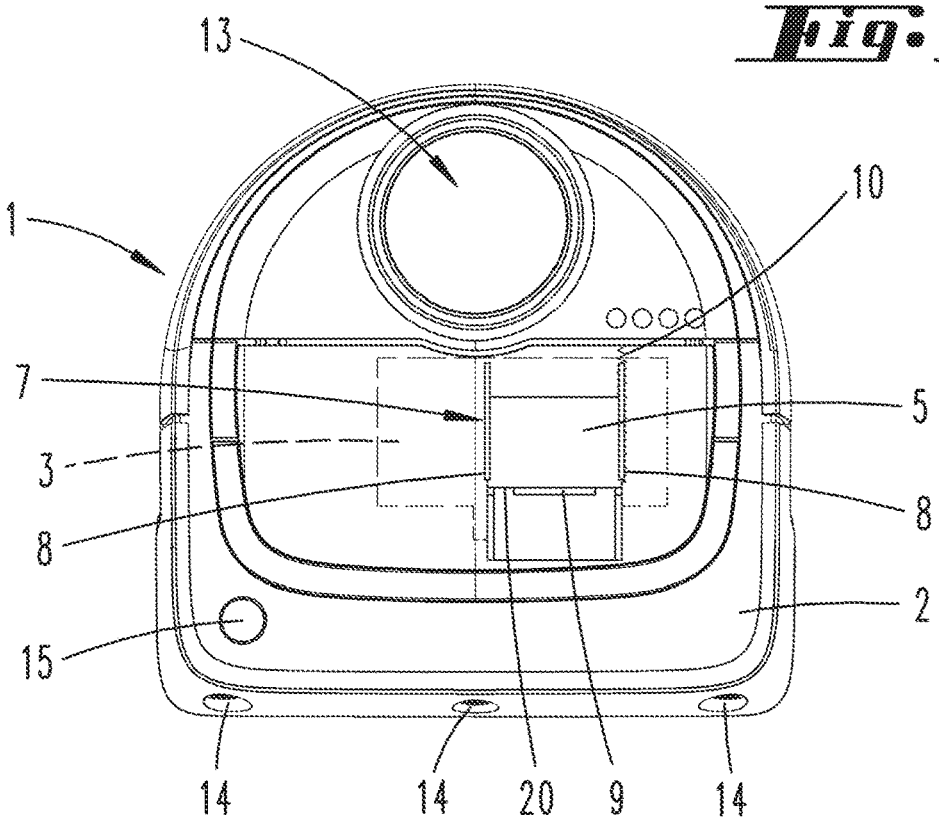
FIG. 1 shows a robotic vacuum cleaner according to the invention with a closure element in a closed position.

FIG. 1 shows an example of a robotic vacuum cleaner 1, which is designed for automatic movement. To this end, the robotic vacuum cleaner 1 conventionally has motor-driven wheels 16 (see FIGS. 3 and 4) and a navigation device, by means of which the robotic vacuum cleaner 1 can orient and localize itself in an environment. For this purpose, the robotic vacuum cleaner 1 has a distance measuring device 13, for example which can be a laser triangulation measuring device. Based on the determined distance values, the robotic vacuum cleaner 1 generates an area map, which the robotic vacuum cleaner 1 can use to plan a traveling path in the environment or localize itself.

While the robotic vacuum cleaner 1 has a suction device, other cleaning functions can also be integrated, for example an additional mopping function. The suction device has a fan and an electric motor (not shown) that drives the fan, which can draw suction material from a surface to be cleaned into a filter chamber 3 of the robotic vacuum cleaner 1. The robotic vacuum cleaner 1 further has several cleaning elements 17 for acting on a floor surface to be cleaned, here for example a rotating side brush and a bristle roller that rotates around an essentially horizontal axis. A switch 15 of the robotic vacuum cleaner 1 is used to turn on the suction device and/or cleaning elements 17 of the robotic vacuum cleaner 1, so as to start a conventional cleaning operation. In order to avoid a collision with obstacles in the environment, the robotic vacuum cleaner 1 further has obstacle sensors 14, for example ultrasound sensors, which relative to a conventional forward motion of the robotic vacuum cleaner 1 are arranged at the front on a housing 2 of the robotic vacuum cleaner 1.

Figure 2:
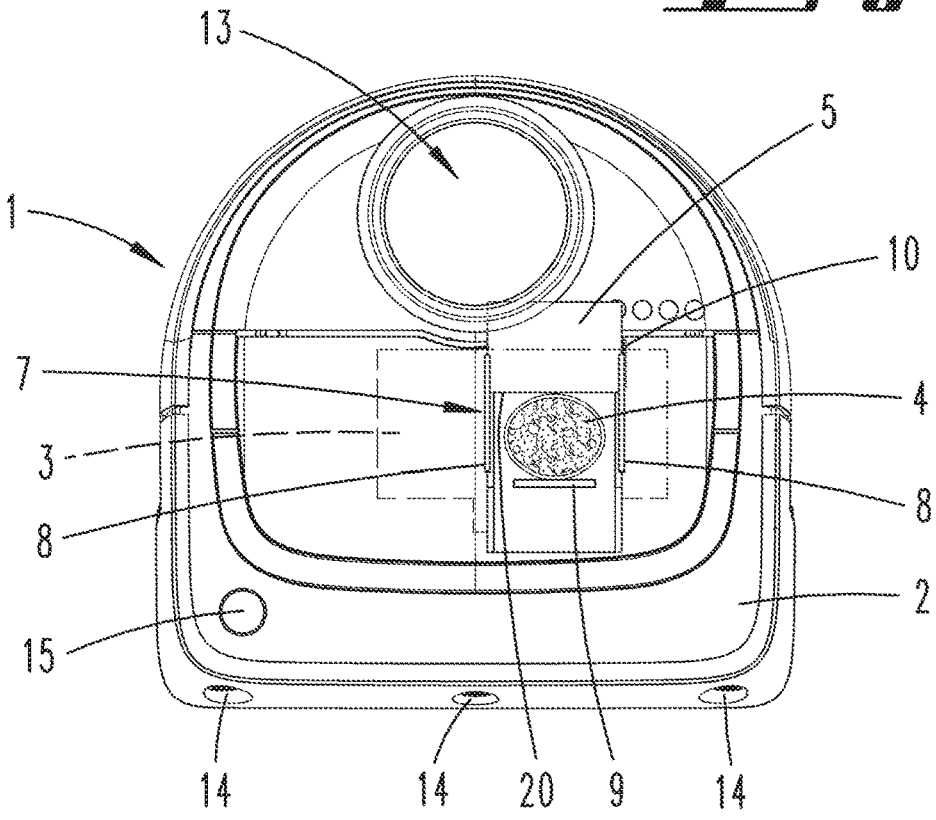
FIG. 2 shows the robotic vacuum cleaner according to FIG. 1 with the closure element in a released position.

Formed on the upper side of the housing 2 is a housing opening 4 (see FIG. 2), which simultaneously opens the filter chamber 3. A flow connection can exist between the housing opening 4 and filter chamber 3, for example by way of a suction channel section, or the housing opening 4 can simultaneously be a filter chamber opening of the filter chamber 3, so that when the housing opening 4 is being opened, the filter chamber 3 is opened, and suction material can simultaneously be vacuumed out of the filter chamber 3.

A closure element 5 is allocated to housing opening 4 of the robotic vacuum cleaner 1. Closure element 5 is mounted on the housing 2 in a linearly movable manner. The closure element 5 is here movably mounted via a guiding device 7 in such a way that the closure element 5 can be displaced from the closed position shown on FIG. 1 into the released position shown on FIG. 2. For example, the guiding device 7 here has two oblong guiding elements 8, which extend parallel to each other and form guiding rails for the closure element 5. The closure element 5 has allocated to it a displacement device 10, here for example a spring element, the restoring force of which is directed in the direction of the closed position of the closure element shown on FIG. 1. However, the displacement device 10 can also be an actuator, for example a linear drive with an electric motor or the like, which can displace the closure element 5 into the closed position, and possibly also into the released position. Also defined on the closure element 5 is an engagement area 20, which according to the embodiment shown here corresponds to a lateral edge of the closure element 5. The function of the engagement area 20 will be explained later. A detection device 9 is also allocated to the housing opening 4 of the robotic vacuum cleaner 1.

Figure 3:
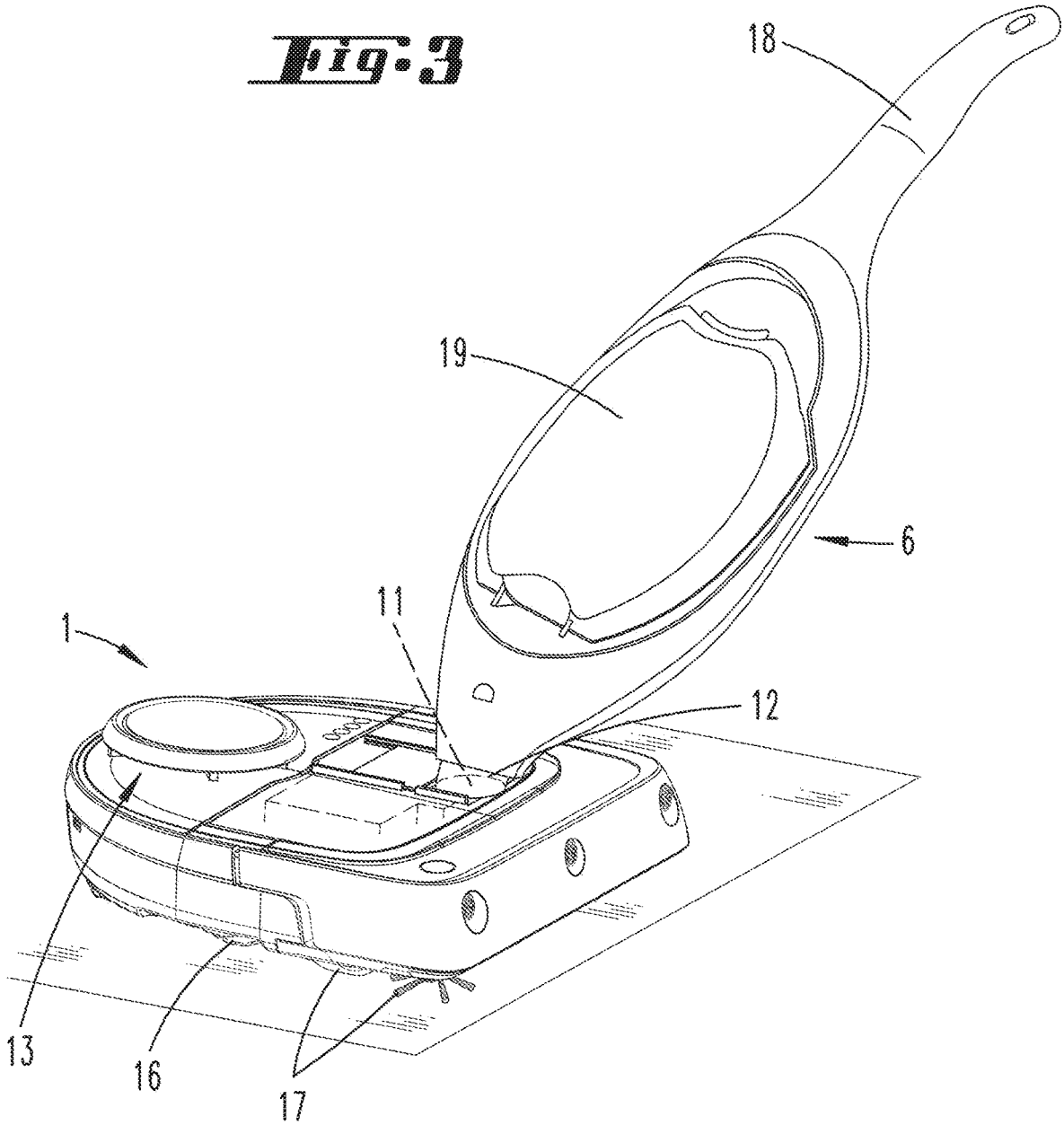
FIG. 3 shows a system comprised of the robotic vacuum cleaner depicted on FIGS. 1 and 2 and an external vacuum cleaning apparatus in a first position.
Figure 4:
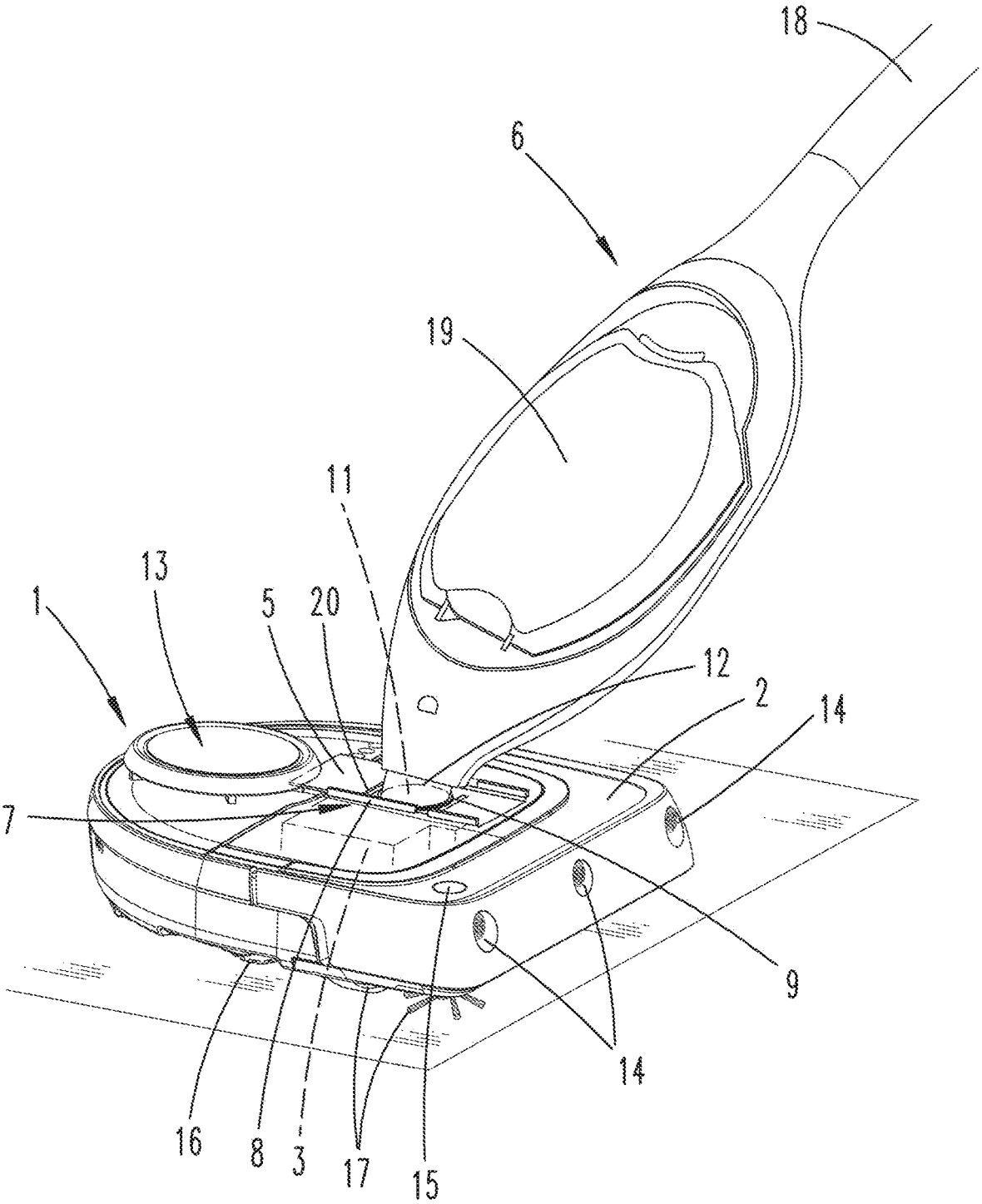
FIG. 4 shows the system according to FIG. 3 in a second position.

FIGS. 3 and 4 show the robotic vacuum cleaner 1 with an external vacuum cleaning apparatus 6. For example, the vacuum cleaning apparatus 6 is here designed as a manually guided vacuum cleaner. The vacuum cleaning apparatus 6 has a stalk 18, with which the user can guide the vacuum cleaning apparatus 6 over a surface to be cleaned. The vacuum cleaning apparatus 6 further has a conventional suction fan with an electric motor, so that suction material can be collected in a separate filter chamber (not shown). A chamber cover 19 is formed on the housing of the vacuum cleaning apparatus 6, so that the filter chamber or a filter bag can be removed from the vacuum cleaning apparatus 6. A partial area 12 of the vacuum cleaning apparatus 6 has a suction opening 11, at which the fan generates a vacuum. In the system shown, the suction opening 11 is designed so as to correspond in terms of shape to the housing opening 4 of the robotic vacuum cleaner 1, so that the suction opening 11 or the partial area 12 can be connected with the housing opening 4 of the robotic vacuum cleaner 1 in order to vacuum out the filter chamber 3 of the robotic vacuum cleaner 1.

If a user of the robotic vacuum cleaner—or preferably the robotic vacuum cleaner 1 autonomously—recognizes that the filter chamber 3 of the robotic vacuum cleaner 1 should be regenerated, the user guides the external vacuum cleaning apparatus 6 toward the robotic vacuum cleaner 1, specifically into the area of the housing opening 4, with which the partial area 12 of the vacuum cleaning apparatus 6 having the suction opening 11 is to be connected.

In a possible embodiment, for example, the detection device 9 of the robotic vacuum cleaner 1 can be designed as an imaging device, and recognize when an external vacuum cleaning apparatus 6 is approaching the housing opening 4 of the robotic vacuum cleaner 1. A control device of the robotic vacuum cleaner 1 can then activate a displacement device 10, specifically in particular an electric motor, so as to displace the closure element 5 inside of the guiding device 7 from a closed position into a released position, until the housing opening 4 is open for connecting the suction opening 11 of the vacuum cleaning apparatus 6 with the housing 2 of the robotic vacuum cleaner 1 or its filter chamber 3. The filter chamber 3 can then be regenerated by means of the fan of the vacuum cleaning apparatus 6. As soon as the user has once again removed the vacuum cleaning apparatus 6 from the housing opening 4 of the robotic vacuum cleaner 1, the displacement device 10 and/or a spring element acts in the direction of a restoring force, until the closure element 5 has been displaced over the housing opening 4, thereby closing the latter.

An alternative embodiment can provide that it not be the user who connects the partial area of the robotic vacuum cleaner 6 with the housing opening 4 of the robotic vacuum cleaner 1, but rather that the robotic vacuum cleaner 1 itself maneuver in such a way relative to the external vacuum cleaning apparatus 6 that the housing opening 4 lies under the suction opening 11 of the external vacuuming apparatus 6 or comes into contact with the latter. The housing opening 4 was preferably already opened automatically beforehand, so that a flow connection can be directly established between the robotic vacuum cleaner 1 and the vacuum cleaning apparatus 6.

In another possible embodiment, the robotic vacuum cleaner 1 and external vacuum cleaning apparatus 6 are connected with each other fully automatically, without a user holding the vacuum cleaning apparatus 6 having to finely adjust the vacuum cleaning apparatus 6 by hand relative to the housing opening 4 of the robotic vacuum cleaner 1. According to this variant, the user guides the vacuum cleaning apparatus 6 up to the robotic vacuum cleaner 1, for example as shown on FIG. 3, until the partial area 12 having the suction opening 11 contacts the detection device 9, e.g., here specifically a contact sensor. For example, the detection device 9 has an electromechanical switch, which is activated by the partial area 12 of the vacuum cleaning apparatus 6 in such a way as to close an electrical circuit, whereupon the control device of the robotic vacuum cleaner 1 then controls the movement relative to the vacuum cleaning apparatus 6. The partial area 12 of the vacuum cleaning apparatus 6 is here located between the guiding elements 8 of the guiding device 7 of the robotic vacuum cleaner 1. The contact signal of the detection device 9 is transmitted to the control device of the robotic vacuum cleaner 1, which thereupon transmits a navigation command to the robotic vacuum cleaner 1 in such a way as to control a defined movement of the robotic vacuum cleaner 1 that is suitable to bring the housing opening 4 of the robotic vacuum cleaner 1 and the suction opening 11 of the vacuum cleaning apparatus 6 toward each other. The movement of the robotic vacuum cleaner 1 is here controlled in such a way that the engagement area 20 of the closure element 5 of the robotic vacuum cleaner 1 bumps against the partial area 12 of the vacuum cleaning apparatus 6, and given a continued movement of the robotic vacuum cleaner 1 is displaced from the closed position depicted on FIG. 3 into the released position depicted on FIG. 4. The closure element 5 is here displaced into the released position parallel to the longitudinal extension of the guiding elements 8 of the guiding device 7, while the partial area 12 of the vacuum cleaning apparatus 6 likewise changes its position inside of the guiding device 7 until the suction opening 11 comes into contact with the housing opening 4 of the robotic vacuum cleaner 1. For example, the closure element 5 is displaced against a restoring force of a displacement device 10 designed like a spring element. In this way, the spring element is tensioned, and once the vacuum cleaning apparatus 6 has been separated from the robotic vacuum cleaner 1 can be again displaced into the closed position. The guiding geometry of the guiding device 7 provides a deepened guiding area, so that the user cannot slip from the robotic vacuum cleaner 1 with the partial area 12 having the suction opening 11 upon stopping the vacuum cleaning apparatus 6. The autonomous movement of the robotic vacuum cleaner 1 is such that the user need only keep the vacuum cleaning apparatus 6 held in their hand in position, and possibly press it downward a bit against the robotic vacuum cleaner 1, wherein the inherent weight force of the vacuum cleaning apparatus 6 can also be enough for the contact sensor of the detection device 9 to respond.

If necessary, the suction opening 11 or the partial area 12 of the vacuum cleaning apparatus 6 having the suction opening 11 can have a sensor, which detects a proper connection between the suction opening 11 and the housing opening of the robotic vacuum cleaner 1, wherein a control device of the vacuum cleaning apparatus 6 then turns on the fan of the vacuum cleaning apparatus 6 and sets a corresponding suction power level, which is suitable for achieving an optimal cleaning result while vacuuming out the filter chamber 3 of the robotic vacuum cleaner 1. If necessary, for example, an opening edge of the housing opening 4 of the robotic vacuum cleaner 1 could have a sensor, so as to start a fan of the robotic vacuum cleaner 1, which additionally vacuums out the filter chamber 3 in the direction of the vacuum cleaning apparatus 6, thereby advantageously supporting the vacuuming activity of the external vacuum cleaning apparatus 6.

Although only a few embodiments of the present invention have been shown and described, it is to be understood that many changes and modifications may be made thereunto without departing from the spirit and scope of the invention.

REFERENCE LIST

1 Robotic vacuum cleaner
2 Housing
3 Filter chamber
4 Housing opening
5 Closure element
6 Vacuum cleaning apparatus
7 Guiding device
8 Guiding element
9 Detection device
10 Displacement device
11 Suction opening
12 Partial area
13 Distance measuring device
14 Obstacle sensor
15 Switch
16 Wheel
17 Cleaning element
18 Stalk
19 Chamber cover
20 Engagement area

What is claimed is:

1. An automatically moving robotic vacuum cleaner comprising:

a housing having a housing opening that is formed on an upper side of the housing relative to a usual orientation of the robotic vacuum cleaner during an automatic movement, a filter chamber disposed in the housing and being configured for receiving suction material, a displaceable closure element mounted on the housing in a linearly movable manner, the closure element being configured to be displaced from a closed position that closes the housing opening into a released position that releases the housing opening, so as to enable access to the filter chamber for vacuuming out of an interior of the filter chamber by means of an external vacuum cleaning apparatus manually guided by the user, wherein an engagement area of the closure element for shifting the closure element from outside of the housing is mechanically contactable, a detection device disposed in an area of the housing opening and being configured to detect the presence of the external vacuum cleaning apparatus to be connected with the housing opening, and a control device that is configured to control an opening of the housing opening if the presence of the external vacuum cleaning apparatus is detected, wherein the control device is configured to initiate the displacement of the closure element into the released position via a movement of the robotic vacuum cleaner against the external vacuum cleaning apparatus, so that the closure element is displaced into an open position through exposure to a mechanical force of the external vacuum cleaning apparatus.

2. The robotic vacuum cleaner according to claim 1, further comprising a guiding device configured for guiding a sliding displacement of the closure element, wherein the guiding device is arranged on the robotic vacuum cleaner relative to the housing opening in such a way that the closure element can be shifted along the guiding device from the closed position into the released position and vice versa.

3. The robotic vacuum cleaner according to claim 2, wherein the guiding device has two guiding elements that run parallel to each other, along and between which the closure element is slidably mounted, wherein the guiding elements are part of a slotted guide or rail guide.

4. The robotic vacuum cleaner according to claim 1, further comprising a displacement device that displaces the closure element.

5. The robotic vacuum cleaner according to claim 1, wherein the detection device has a contact sensor or a magnetic field sensor or an imaging device.

6. The robotic vacuum cleaner according to claim 1, wherein the detection device is configured to recognize a position and/or orientation of the external vacuum cleaning apparatus relative to the housing opening of the robotic vacuum cleaner.

7. The robotic vacuum cleaner according to claim 6, wherein the control device is configured to control a movement of the robotic vacuum cleaner relative to the external vacuum cleaning apparatus as a function of a detection signal of the detection device in such a way that the housing opening comes into contact with the external vacuum cleaning apparatus so as to establish a flow connection between the filter chamber of the robotic vacuum cleaner and a suction opening of the external vacuum cleaning apparatus.

8. A system comprised of an automatically moving robotic vacuum cleaner according to claim 1 and the external vacuum cleaning apparatus configured to be manually guided by a user, wherein the housing opening of the robotic vacuum cleaner and a correspondingly shaped suction opening of the vacuum cleaning apparatus are configured to be connected with each other in such a way that the filter chamber of the robotic vacuum cleaner can be vacuumed out by means of the vacuum cleaning apparatus.

9. The system according to claim 8, wherein the closure element of the robotic vacuum cleaner can be moved from the closed position into the released position by means of a partial area of the vacuum cleaning apparatus having the suction opening.

10. The system according to claim 9, wherein the robotic vacuum cleaner has a guiding device, which is designed both for guiding the closure element and for guiding the partial area of the vacuum cleaning apparatus having the suction opening.

* * * * *